US006113384A

United States Patent [19]

Sebastiani

[11] Patent Number: 6,113,384

[45] Date of Patent: Sep. 5, 2000

[54] REGULATION OF GAS COMBUSTION THROUGH FLAME POSITION

[76] Inventor: Enrico Sebastiani, Via Sattle Banfi, 13, 1-20025, Legnano, Italy

[21] Appl. No.: 09/155,247

[22] PCT Filed: Mar. 25, 1997

[86] PCT No.: PCT/EP97/01519

§ 371 Date: Sep. 24, 1998

§ 102(e) Date: Sep. 24, 1998

[87] PCT Pub. No.: WO97/36135

PCT Pub. Date: Oct. 2, 1997

[30] Foreign Application Priority Data

Mar. 25, 1996 [IT] Italy ..... MI96A0588

[51] Int. Cl.[7] ..... F23N 3/08; F23N 5/04; F23N 5/08; F23N 5/12

[52] U.S. Cl. ..... 431/12; 431/18; 431/75; 431/79; 431/89

[58] Field of Search ..... 431/79, 12, 18, 431/62, 63, 75, 186, 350, 354, 89; 239/562, 75; 60/749

[56] References Cited

U.S. PATENT DOCUMENTS

| | | | |
|---|---|---|---|
| 3,587,232 | 6/1971 | Brice | 431/350 |
| 4,373,901 | 2/1983 | Kaplan et al. | 431/350 |
| 4,588,372 | 5/1986 | Torborg | 431/78 |
| 5,104,311 | 4/1992 | Maughan et al. | 431/75 |
| 5,385,467 | 1/1995 | Sebastiani et al. . | |
| 5,393,222 | 2/1995 | Sutton . | |
| 5,641,282 | 6/1997 | Lee et al. | 431/7 |
| 5,667,375 | 9/1997 | Sebastiani | 431/12 |

FOREIGN PATENT DOCUMENTS

| | | | |
|---|---|---|---|
| 0 643 264 | 3/1995 | European Pat. Off. . | |
| 0 643 265 | 3/1995 | European Pat. Off. . | |
| 000273096 | 11/1989 | Germany | 431/75 |
| 41 12 449 | 10/1991 | Germany . | |
| 93 18 426 | 2/1994 | Germany . | |
| 0183316 | 7/1988 | Japan | 431/75 |
| 2204428 | 11/1988 | Japan | 431/79 |
| 402302519 | 12/1990 | Japan | 431/75 |
| 5-52311 | 3/1993 | Japan | 431/350 |
| 5-280715 | 10/1993 | Japan | 431/350 |

*Primary Examiner*—Carl D. Price
*Attorney, Agent, or Firm*—Morgan & Finnegan, L.L.P.

[57] ABSTRACT

A combustion system includes a combustion chamber. A fan is connected to the combustion chamber. The fan has a spin velocity. A burner is adjacent the combustion chamber. The burner defines one or more flame openings. Each flame opening has a cross section. An obstacle is associated with each of the one or more flame openings. Each obstacle is within the combustion chamber. A mixture of fuel gas and air having a mixture temperature is discharged at a discharge velocity from the one or more flame openings. A flame is positioned along the burner substantially detached from the one or more openings. A flame position sensor senses the position of the flame and generates a flame position signal based on the sensed position of the flame. A control processor maintains the flame around a prefixed optimum position by controlling a characteristic variable quantity of the mixture based on the flame position signal. The characteristic variable quantity is selected from a premixture rate value of the mixture, the discharge velocity, and the mixture temperature upstream of the flame. The discharge velocity is modified by varying the cross section of the flame openings and the spin velocity of the fan.

27 Claims, 9 Drawing Sheets

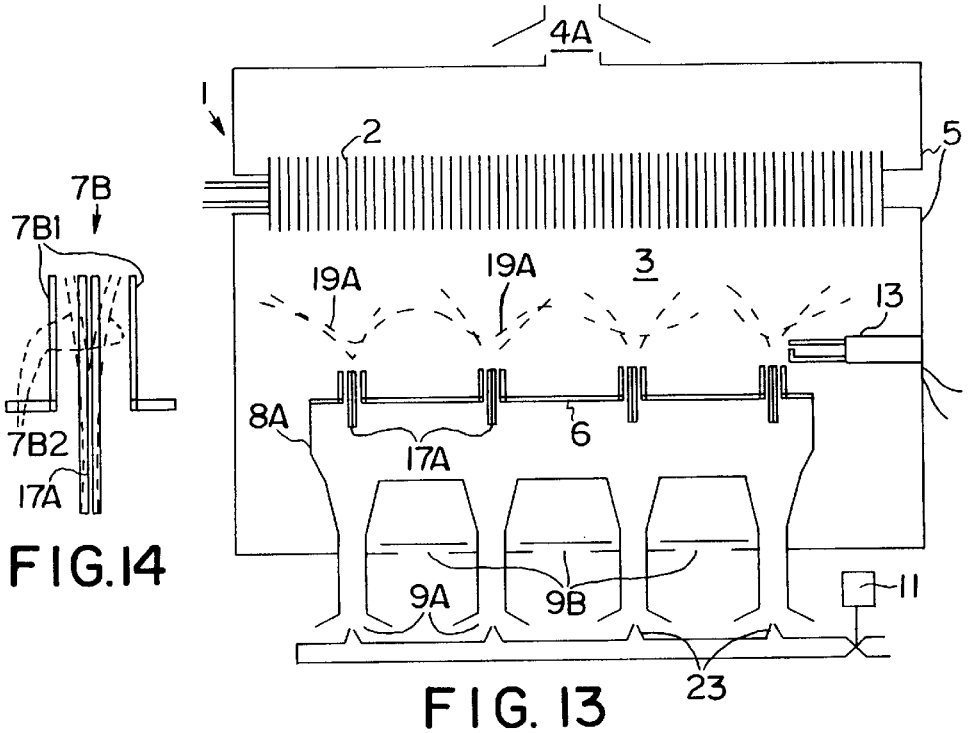
FIG.14
FIG. 13
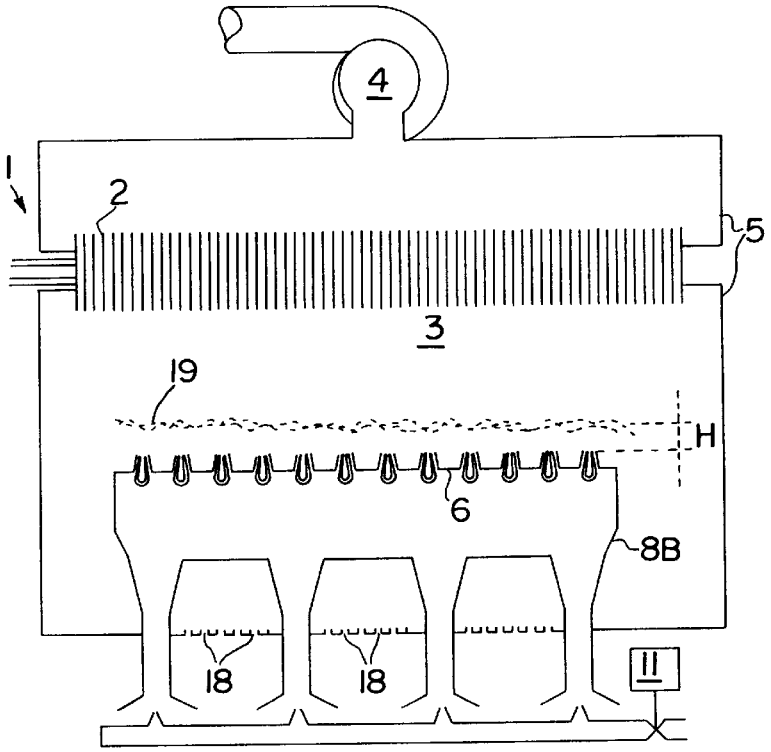
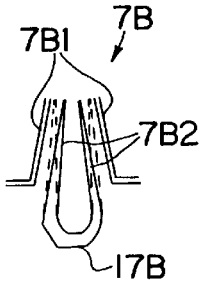
FIG. 16
FIG. 15

REGULATION OF GAS COMBUSTION THROUGH FLAME POSITION

FIELD OF THE INVENTION

The present invention relates to gaseous fuel combustion systems and in particular to a method and apparatuses in accomplishment of same, for controlling the combustion to obtain: flame stability, low emissions, in the most wide field of burner capacity modulation required in practice, even in feeding conditions with limit gases, in a so simple and practical way to be used also for apparatus with capacity of only few KW.

The gas combustion system is the assembly of the burner with, the combustion chamber, the heat exchanger, the means for the circulation of air and exhausts, if existing, as well as the control apparatus with its sensors; more elements of the assembly can form a sole body therefore a distinction only possible for functions.

The gas combustion systems are the main functional assembly of domestic and industrial appliances as central heating boilers, water heaters, of two main types: istantaneous and storage water heater, room heater and furnaces, gas cookers etc..

For burner it is understood the fictional assembly of the parts which create the mixture of air and fuel-gas and make possible the outflowing of them in the combustion chamber through the flame openings.

The invention applies in particular to fuel-gas combustion systems, where the mixture, formed by air, said primary air, and fuel gas (hereafter simply said mixture) is by approx. stoichiometric to strongly hyperstoichiometric ($0.95<\lambda<1.6$, where $\lambda$ is the ratio between air actually present in the mixture and the air existing in the stoichiometric mixture of the same gas in the same conditions); flow in combustion chamber, out from the flame openings of the burners with substantially laminar flow, having an out flow velocity between 0.2 and 4.0 meter per second, and generates a lamellar flame, means of big surface and minimum thickness (magnitude order of a millimetre), this means that the ratio surface thickness is well over a value of ten, substantially detached from the area occupied by the flame openings; the flame front, that is the surface where the combustion starts, coincides with the flame itself being the combustion monostadium for the presence of all the necessary oxygen since the ignition and is from laminar to wrinkled. The invention applies to combustion systems with gas atmospheric burners but also with forced burners, where the air gas mixture is obtained, in the wanted flow and composition, with the help of auxiliary means (for example fans, or compressors) both types operate either with the presence of secondary air (called partially pre-mixed burners) or with only primary air (called totally pre-mixed burners). In all types of burners the mixture outflows from the flame openings with a velocity fairly higher to the flame speed so as to avoid that the flame adheres to the opening itself (flame substantially detached).

In the combustion chamber the mixture ignited, at least initially, by suitable ignition devices, forms the flame which is kept in stability conditions from a sort of anchorage system, acting at least in some points. Opening configurations, in particular slots obtained in thin thickness sheet, so close to create an almost homogeneous sole jet of mixture are considered single flame opening. The front of flame is recognisable because it emits in the visible, even if the specific maximum emission due to OH and CH ions is respectively in the wavelength between 305 and 320 mm and around 431.5 and 438 mm.

BACKGROUND OF THE INVENTION

A problem arises when instead of the standard fuel-gas for which the apparatus is set, a fuel-gas from the same family as said standard fuel-gas but prone on flame blow-off or prone to flash back are fed. Specifically, the burner flame openings surface may attain critical temperature value, and in some other occasion, the flame may become unstable, resulting in poor combustion of fuel-gas.

A method, applicable to highly premixed but only atmospheric burners, to maintain stable the temperature of the flame openings and reduce the harmful emissions by the variation of —$\lambda$— in the mixture according to the temperature of the flame openings itself is described in the European patent of the author EP0606527A1 deposited on Aug. 16, 1993, but don't take into consideration the flame, its position, shape or density, particularly is not considering a lamellar flame detached from the area of the flame openings.

It is also known a method described in patent DE3630177 dated Sep. 4, 1986 where the signal of the ionisation current, inside the large volume of a turbulent flame, is used for the variation of —$\lambda$— nevertheless it is a signal relating to the combustion conditions inside the big volume of the turbulent flame itself, not of the ionisation conditions of the unburned mixture just upstream the flame front, so at conditions prior to the combustion. This signal is typical of the combustion conditions, specifically as to the limit of stability for the turbulent combustion, don't give any information about the position of the flame front or the flame distance. Furthermore the considered emission of UV, without description of how it is and how it can be used, would seem to determine the combustion condition as to the limit of the stability for turbulent combustion.

Control systems which vary the total quantity of air or of primary air basing itself on a temperature in combustion chamber, on the excess of air in fuels, either combined or not with air variation according to the flow rate of fuel-gas fed, are known. However none of these take into account the influence of gases different from the standard one which can be distributed in sequence without notice and therefore feed the combustion system, nor can they maintain the stability of the flame in large ranges of capacity modulation, nor take into account the combustion of a hyperstoichiometric mixture in substantially laminar flow, particularly with lamellar flames.

These latter control systems and similar ones are complex, in particular for the type and positioning of the sensors, consequently, too expensive for gas appliances of flow limited to even few KW.

None of the previously considered control systems take into account the temperature as well the outflow velocity of the mixture.

DISCLOSURE OF INVENTION

The aim of this invention is to provide a method and apparatuses in fulfilment of same, for the control of the flame position driving the value of at least one of the variable quantities characteristic of mixture outflowing from the flame openings into the combustion chamber; —$\lambda$, the velocity, the temperature; in eliminating the aforementioned difficulties it makes possible the proper regulation also in very compact combustion systems, even forming a sole body.

This aim is reached by applying the method so that, having a method for the regulation of a combustion system where the fuel-gas air mixture, wich is from almost stoichiometric to strongly hyperstoichiometric, outflows from at least one flame opening of a premixed burner, with velocity and modalities such as to obtain a lamellar flame, substantially detached from the area of at least one flame opening; characterised by the fact that to maintain the flame around a prefixed optimum position at least one of the three variable quantities of the mixture is varied: the value of premixture rate λ, the outflow velocity, the temperature upstream the flame front.

It is possible to define the position of the flame as the distance between the barycenter of the flame front and the surface of at least one flame opening which generates this front, hereafter said quantity will be called flame distance.

The flame distance optimum value can generally be predetermined arbitrary constant, but can have different values according to the fuel-gas flow rate; in any case, during the on periods on the combustion system, the instantaneous ratio, which is the detected flame distance/optimum flame distance, have the value 1 for the reached conditions considered as optimum, values over 1 show a tendency of the flame to blow-off increasing as the ratio increases, values under 1 show the tendency to overheat the burner head increasing as the ratio decreases.

The istantaneous ratio: detected flame distance/optimum flame distance, will be hereafter called flame ratio.

To obtain the regulation desired at least one of said variable quantities of the mixture is varied according to the flame ratio as per the following modalities:

- the λ premixture value is varied between a prefixed minimum and maximum value according to the flame ratio, a flame ratio>1 causes a λ decrease and vice versa;
- the outflow mixture velocity is modified through the variation of the outflow cross section of at least one flame opening, between a minimum section and a maximum one, according to the flame ratio, a flame ratio>1 causes an outflow section increase and vice versa.
- the temperature, of the mixture outflowed from at least one flame opening, between a prefixed minimum and maximum value, is varied, upstream the flame front, according to the flame ratio, a flame ratio>1 causes a mixture temperature increase and vice versa.

The regulation method of the invention can detect the quantity indicative of the flame distance, through the position of the radiation source in the different frequencies of the flame itself, through the temperature detected at least upstream the flame front and in the immediate proximity of said front and through the ionisation current measured at least upstream the flame front and in the immediate proximity of said front at least in average value.

In a first variant, the value of the premixing rate λ is changed between prefixed minimum and maximum values according to the flame ratio, a flame ratio>1 causes a λ decreases and vice versa, so as to maintain said flame distance around a given value, except for different regulation during temporary periods, for example during starting, when needed.

In particular in case of use of a sole fuel-gas and with constant cross-section of the flame opening(s), the prefixed maximum and minimum values corresponds respectively to the minimum flow and maximum flow of the burner.

It is also provided a simplified regulation, at steps, which varies λ between a minimum value and a maximum one if said flame distance either decreases or increases respectively.

A modified regulation can provide, at ignition, to increase the flame speed that otherwise would be too low, a mixture temperature increase obtained with heat transfer to the mixture brought to such a value to obtain the first and the cross-ignition, the heat transfer can remain as such for a determined period, for example for 10 seconds, or for wall temperatures of the flame opening below a given value.

By adopting the variation of the λ value in mixture, as described, if the composition of the fuel-gas feeding and/or the temperature of the mixture and also the cross-section of the flame opening(s) do not change, variation of outflow-velocity of the mixture remains in reduced limits, for the reasonable range of burner modulation, with small movement of the flame front, even without any further regulation.

In a second variant a basic value of λ is defined in linear relationship to the fuel-gas flow rate, detected through the fuel-gas injector pressure, corrected, between prefixed minimum and maximum deviation, according to the flame ratio, different regulation during temporary periods, for example during starting, is provided, when needed.

In a third variant, to enlarge the capacity modulation field of the combustion system even to a modulation ratio 1/10, besides the λ variation as per above first variant, the outflow velocity of the mixture is maintained almost constant by changing the cross section of at least one flame opening according to the instantaneous flow-rate of gas however detected (for example by using the flame density). Where the flame density is the specific concentration of the combustion and, if other parameters do not change, is index of the instantaneous gas flow rate.

In a fourth variant, together with the regulation as per first variant, it is also possible to vary the outflow velocity of the mixture from the flame openings, according to the temperature of the openings(s) by reducing the section at an increase of the temperature and vice versa.

In all the previous variants, changes of the conditions of the flame stability at constant fuel-gas flow rate, due to a modification of the flame speed for the change of the composition of the gas employed and/or of the temperature of the mixture (for example: for temperature changes of the inlet air), cause a deplacement of the flame front, and, because the relation between λ and the flame position, a correction of the λ value is obtained such as to restore the stability conditions of the flame.

At ignition, in order to improve the stability conditions, the λ value is the minimum provided and can stay as such for a fixed period, for example for at least ten seconds, or for wall temperatures of the flame openings below a certain value, for example around 200° C., then modifying itself according to the flame position.

A fifth variant of the method provides that the outflow cross-section of the flame opening/s is varied according to the flame ratio, between a minimum and a maximum cross-section, causing a flame ratio>1 causing an outflow section increase and vice versa, so as to maintain the flame distance around a pre-fixed value, except for a different regulation during the transient periods, for example of starting, when needed.

A simplified regulation which, according to the flame ratio, varies the outflow cross-section of the flame openings between a minimum value and a maximum one, in one or more steps, opening or closing one or more flame openings if said flame ratio increases or decreases is also provided.

By adopting the flame ratio, or any variable quantity which follows the same variation law, as control-parameter for the variation of the outflow cross-section of the flame opening/s, it is possible to reduce at the minimum the variation of the outflow velocity at the change of the burner capacity by maintaining the flame stable and the emissions reduced.

If the composition of the feeding gas and/or the temperature of the mixture do not change, in particular in atmospheric burners, through the continuous variation of the mixture outflow velocity, as previously described, the value of λ in the mixture itself is maintained in reduced limits, in a range of burner capacities, favourably keeping almost fixed the flame front, without any further regulation.

Changes of the stability conditions of the flame at constant burner capacity, due to variation of the flame speed for the change of λ and/or of the composition of the feeding gas and/or of the mixture temperature, cause a correction of the outflow cross-section, such as to favour the restoration of the stability conditions of the flame, that means increase of the outflow section in case of decrease of the flame speed and therefore tendency for the flame to blow-off and the opposite if said speed increases that means a tendency for the surface of the flame opening/s to overheat.

When the burner is in off condition the cross-section of the flame opening(s) can be the maximum possible and can remain as such for a pre-fixed period, for example for approximately ten seconds, during the ignition phase, then modifing according to the regulation law.

Otherwise in order to improve the stability conditions in transient periods, the modifications of the outflow cross-section can't happen for temperatures of flame openings below a pre-fixed value, usually around 200° C., to obtain an outflow velocity of the mixture lower than the one provided at steady state.

Sixth variant: at the ignition, modifying the fifth variant, the flame speed can be increased through the increase of the mixture temperature, obtained with heat transfer to the mixture, brought to such a value to obtain the first and the cross-ignition; after the ignition, the heat transfer can remain as such for a determined period, for example for 10 seconds, or for wall temperatures of the flame opening below a given value, then will change to drive the mixture temperature according to the variation of fuel-gas flow rate.

Seventh variant: since it has been surprisingly noticed that, in a reasonable range of working conditions, the wall temperature of the flame opening/s or of a body in its immediate vicinity, varies with a law comparable to that of the variation of the flame distance, also the temperature of these bodies compared to an optimum value, according to the invention, can be used as regulation parameter of the outflow cross-section of the flame opening/s variation, by detecting it with thermocouples, thermistors or other.

By increasing the temperature of the flame openings compared to a predetermined value, the method of the invention decreases the outflow cross-section tending to restore the lost equilibrium, by decreasing the temperature ratio it increases said cross-section, when the burner is in off condition the outflow cross-section is the maximum provided.

Controlling in His way the mixture outflow velocity, the temperature of the zone of the flame opening/s it maintains, within acceptable limits (even below 500° C.), the flame stable the emission low, in a reasonable range of burner flow modulation and of kind of feeding gases.

On the eighth variant: the value of the temperature of the mixture upstream the flame front is varied according to the detected flame ratio, causing an increase of the flame ratio an increase of the temperature and vice versa, so as to maintain said flame distance around a given value, except for different regulation during temporary periods, for example during the starting, when needed.

It is also possible a simplified regulation, on-off, which increases the temperature to a maximum one if said flame ratio increases over a predetermined value and during the starting periods.

By adopting either the flame ratio, or any quantity which follows the same variation law of the flame position, as control-parameter for the variation of the mixture temperature, if the composition of the fuel-gas, and/or λ in the mixture and also the cross-section of the flame opening (s) do not change, for the complete range of burner capacity modulation, small movement of the flame front is obtained, even without any further regulation because to a variation of outflow velocity is opposed a flame speed variation in opposite direction.

Changes of the stability conditions of the flame at steady state due to variation of the flame speed for the change of λ and/or of the composition of the feedgin fuel-gas cause a correction of the value of the temperature of the mixture, such as to favour the restoration of the stability conditions of the flame, that means temperature increases in case of decrease of the flame speed and therefore tendency to blow-off of the flame, the opposite if said speed increases that means a tendency to overheating of the surface of the flame opening.

Ninth variant: It is however possible to enlarge the flow modulation field of the combustion system if, besides the regulation as above foreseen, either λ or the outflow velocity of the mixture are varied according to the instantaneous fuel-gas flow-rate, anyhow detected, almost constant λ slightly decreasing the outflow velocity by an increase of the gas flow rate and vice versa; acting so the capacity modulation ratio can even go up to 01/1,.

Tenth variant the method of the invention carries out the temperature variation associated with the variation of the λ value in the mixture or its outflow velocity, all variating according to a quantity, index of the flame ratio as previously described.

Eleventh variant Associated with the temperature variation also it can be varied the outflow velocity of the mixture from the flame openings, according to temperature of the openings decreasing the section by increasing the temperature and vice versa.

At ignition to increase the flame speed that otherwise would be sometime too low, the heat transfer to the mixture can be brought to the maximum value provided to obtain the first ignition and cross-ignition, can remain as such for a determined period, for example for 10 seconds, or for wall temperatures of the flame opening below a given value, for example around 200° C., then be reduced to obtain the temperature of the mixture according to the flame ratio.

By using any variant of the described method, the temperature of the outflow zone of the mixture remains within acceptable limits (even below 400° C.), at any flow condition of the burner, type of feeding gas, temperature of the inlet air the flame remain stable, the harmful emissions are reduced to minima values.

BRIEF DESCRIPTION OF THE DRAWINGS

In order to better understand the invention, its characteristic and the advantages it provides, few embodiments thereof are described hereinafter, by way of non limitative example and with the assistance of the appended drawings, in which FIG. 1 is a general scheme, FIG. 2 detail of the by-pass, FIG. 3 view of the flame openings.

FIG. 4 is a general scheme, FIG. 5 view of the flame openings. FIG. 6 detail of the air-gas regulation.

FIG. 7 is a general scheme, FIG. 8 detail of a flame opening, FIG. 9 detail of the λ regulation system with a sliding sleeve around the fuel-gas delivery nozzle.

FIG. 10 is a front view, FIG. 11 a side view, FIG. 12 a cross section of a flame opening.

FIGS. 13–16 illustrate two combustion systems with atmospheric burners, one with natural draught the second with forced draught, variation of the outflow velocity according to the the temperature of the flame opening FIG. 13 shows a view in vertical cross section of a natural draft combustion system with variation of the outflow cross section according to the temperature of the exit area of the flame openings using bimetallic strips, FIG. 14 shows an enlargement of a flame opening of FIG. 13; FIG. 15 shows a view in vertical cross section of a forced draft combustion system where a bulb according to the reached temperature modifies the outflow cross section of flame openings FIG. 16 shows an enlargement of a flame opening of FIG. 15.

FIG. 17 shows a burner in longitudinal view with a single flame opening interrupted by bimetallic U formed bridges which by tightening the lips of the flame opening modify its cross section, FIG. 18 shows the same burner without the flame to a better comprension of the mecanism and FIG. 19 shows a cross section of a slightly different burner

DETAILED DESCRIPTION OF THE INVENTION

Figure 1:
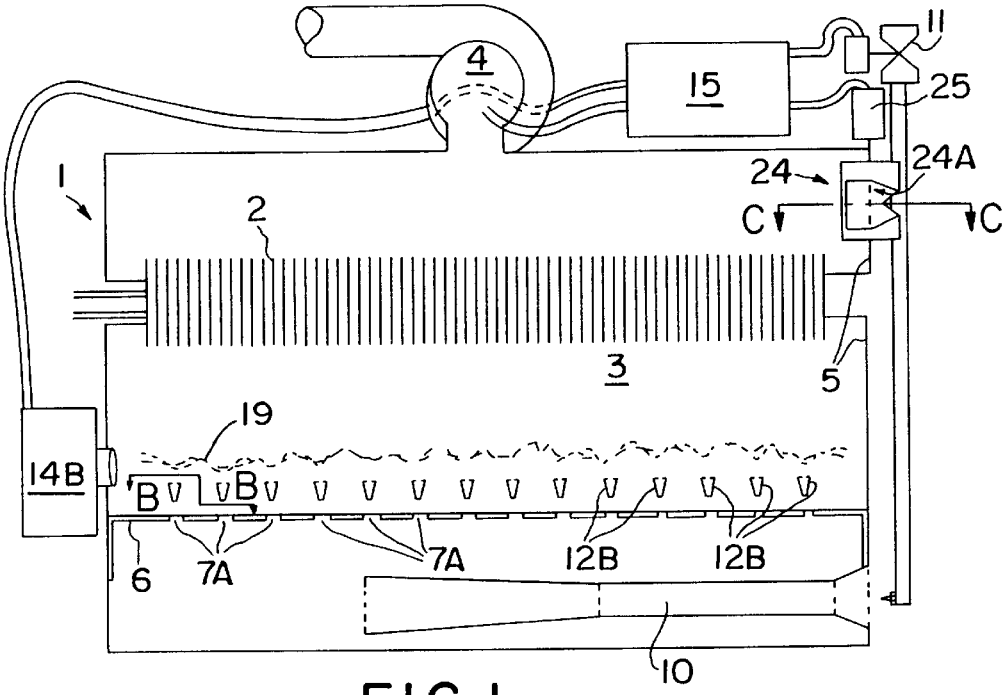

FIG. 1 shows, in vertical cross section A—A a combustion system operating in forced draught with the fan 4 working at constant spin velocity mounted downstream the heat exchanger 2 so the inside of the shell 5 is in depression compared to the outside. The burner 8B, (FIG. 4) the body of which is bottom part of the shell 5, is atmospheric, the air-fuel gas mixture is obtained in a Venturi type tube 10A from the fuel gas exiting the injector 23 and the air from outside the shell 5 entering the mouth 9A. Under the vacuum created by the fan in the combustion chamber 3 with respect to the region outside the shell 5 the mixture is drawn through the Venturi 10A and the mixing chamber 18 to the flame openings 7A, better described in FIG. 3, obtained on the sheet metal, for examples of 0.4–0.6 mm thickness, of the burner head 6.

The flame openings 7A, made of a row of slots each, are spaced centre to centre from 15 to 60 mm to obtain a flying carpet type lamellar flame 19 anchored to external obstacles 12A, visible in V shaped cross section with upstream vertex and centreline of the V, perpendicular to the surface and in centre of the flame openings, parallel to the rows and distant to the slot surface from few to some ten mm according to the cases.

The lamellar flame covers the plan of the combustion chamber 3, lying at level of the optical sensor 14B. The process controller 15 varies the gas flow through the valve 11, according to the heat request and varies λ in the mixture, acting through the by-pass 24 better described in FIG. 2. The open cross section of the by-pass 24 varies with the rotation due to a step by step motor 25, the more the by pass is opened the lower value of λ is obtained. The process controller 15 acts positioning first the by-pass 24, to obtain the minimum value of λ to facilitate the ignition, then, after some ten seconds, changing the by-pass position, according to the flame ratio, an increase of the flame ratio causing a decreasing of λ and vice versa, in order to maintain the flame distance around a pre-fixed optimum value.

Using a different process controll the process controller 15 can also act in a different way: first positioning the by-pass 24 to obtain the minimum value of λ to facilitate the ignition, then after some ten seconds positioning the by-pass 24 to obtain a predetermined value of λ related to the instantaneous fuel gas flow rate, but changing the by-pass position to obtain a λ deviation between a pre-fixed minimum and maximum, according to the flame ratio.

The optical device 14B, based on photo sensor/s, transmits to the process controller 15 one signal corresponding to the detected position of the flame compared to a pre-fixed position, means the flame ratio, and another one proportional to the intensity of the flame radiation, in particular proportional in the radiation frequencies characteristic of OH, CH, C2 radicals.

According to the heat request, the controller 15 varies the instantaneous fuel-gas flow rate by a valve 11 with variable opening, and controlled using the radiation intensity measured by the optical device 14B; the λ value is varied by the by-pass position according to the fuel gas flow, verified by the radiation intensities of OH and C2 compared between them or with total radiation. The flame position can be detected with a single photosensitive element through the oscillation of the optical system with known frequency and amplitude.

Figure 2:
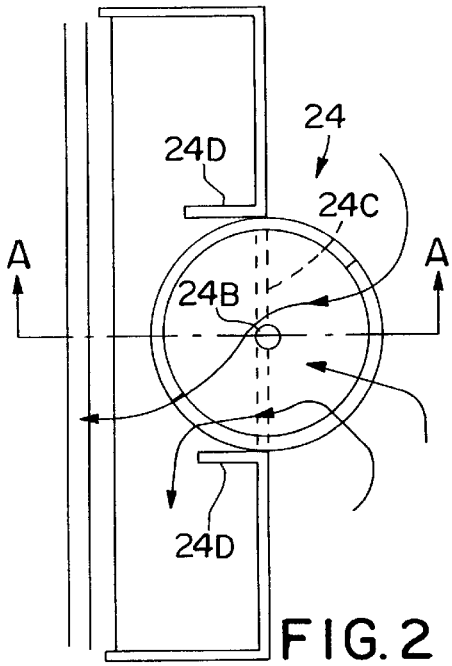

In FIG. 2 is described the air flow through the by-pass 24, constituted by a cylinder with closed heads whose vertical rotation axis 24B lies on the surface of the shell 5 side wall where a window 24C is open, above the heat exchanger 2, with lips towards the inside 24D.

The cylinder side surface being removed for less than 180°; rotating the cylinder anticlockwise, from a nil passage position (wall closed 24E at the outside of the shell 5) we arrive with a rotation of about 120° to a maximum open passage (as in figure), the shape of the opening 24A is such to obtain an air flow into the shell 5, proportional to the rotation angle, in order to simplify the X variation; for maximum gas flow the passage is almost closed, for minimum gas flow open as in figure, in ignition phase the opening is greater than what requested at steady state for the corresponding gas flow, staying in this position for example from 10 to 30 seconds.

Figure 3:
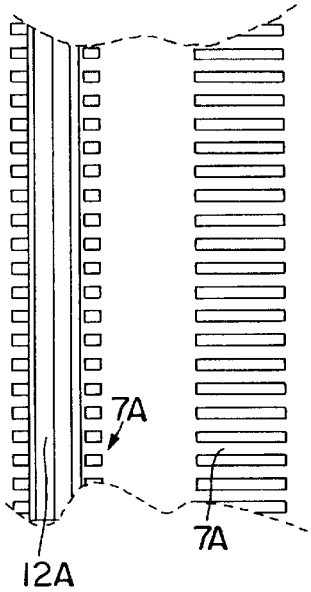
FIGS. 1–3 illustrate a combustion system with totally premixed atmospheric burner, forced draught, λ variation according to the flame distance.

FIG. 3 is a top view B—B in two levels, of a part of the burner's head 6, two flame openings 7A are represented, made of two rows each of parallel slots having width from 0.5 to 0.75 mm and length from 5 to 15 mm, parallel adjacent on the long side, spaced centre to centre from 0.9 to 1.5 mm.

Figure 4:
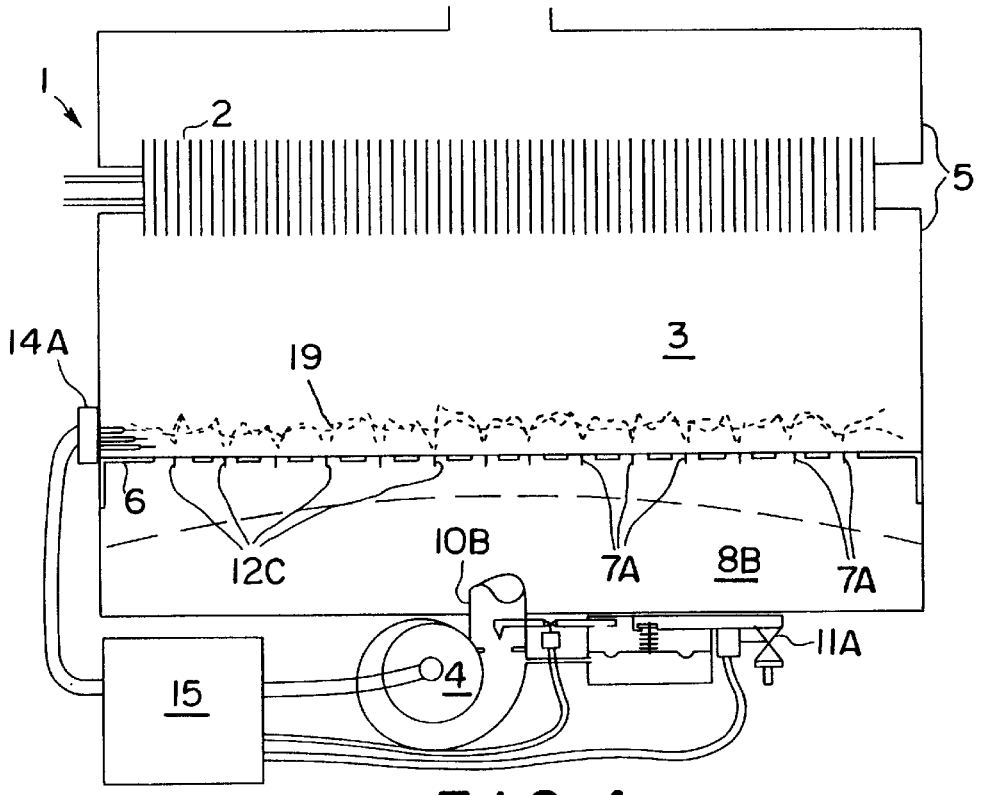
FIGS. 4–6 illustrate a combustion system with totally premixed forced burner, λ variation according to the flame ratio and to the instantaneous air flow rate.
Figure 5:
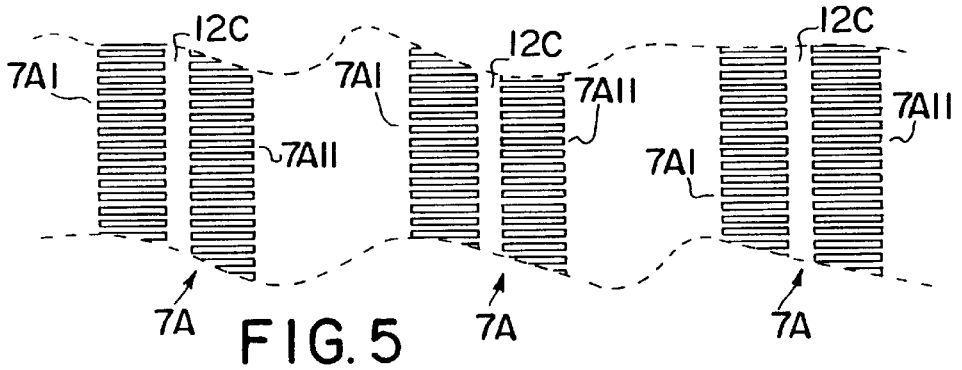

FIG. 4 shows, in vertical cross section, a combustion system 1 with a heat exchanger 2, a combustion chamber 3, a fan 4 for the air gas and exhausts circulation, put upstream the combustion chamber for which this is in over pressure compared to the outside of shell 5, whose inferior part together with the burner head 6 forms the burner 8B body; flame openings 7A better described in FIG. 5, are lengthened, perpendicularly to the drawing surface, formed by two rows of slots each, punched on the sheet metal of the burner head 6. The lamellar flame 19, ignited by a device not in the figure, generates and remains firmly anchored downstream of the flame openings 7A becoming like a wave shaped flying carpet.

The fuel gas valves 11 and 11A (better analysed in FIG. 6) and the fan 4 speed are operated by the process controller 15 according to the signals transmitted by the ionisation current sensor 14A positioned in the volume just upstream flame 19. The sensor has two electrodes, but could have more if needed to enlarge the area under control and have a better definition, transmits the signals which the process controller 15 works out to obtain the average ionisation current values which define the flame distance according to a pre-fixed value, and to obtain amplitude and frequency of oscillation which together with average current value define the flame density, indicator of fuel gas instantaneous flow rate which is used as feedback in the process control.

FIG. 5 shows, from top view, a part of the head burner 6 with three flame openings 7A, obtained from slots punched on thin sheet metal, each made of two rows 7AI and 7AII of parallel slots having width from 0.5 to 0.75 mm length from 5 to 15 mm being adjacent on the long side, spaced centre to centre from 0.9 to 1.5 mm being adjacent on the long metal of 0.4–0.6 mm thickness, which leave in between an unpunched strip 12C, as an example, the 12C width is between 2 and 6 mm. The fluids dynamic obstacle 12C generating downstream a stagnation area, anchors the flame, the openings 7A being parallel double rows close enough, having centre to centre distance from 30 to 120 mm (according to the slots length), generate a wave shaped carpet lamellar flame (19 in FIG. 4) with depression on the vertical of 12C peak half between two adjacent openings 7A.

Figure 6:
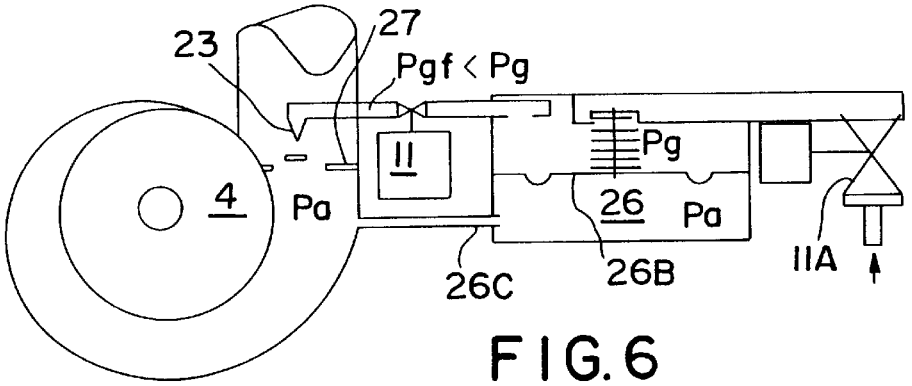

FIG. 6 is an enlarged section of the air-gas regulation system of FIG. 4 where 11A is the on-off valve which allows the fuel-gas to enter the membrane device 26. Inside the device the menbrane 26B balances the PA pressure upstream the diaphragm 27 of the air exiting the fan 4, trasmitted through the connection pipe 26C, with the PG pressure of the fuel-gas exiting the device 26. The fuel-gas then goes through a variable flow valve 11 downstream which the fuel-gas pressure value becomes PGF<PG, the pressure value PGF determines the instantaneous fuel gas flow rate.

The variation of the heat request causes a variation of fan spin velocity, therefore a different air flow rate, a different PA1 pressure and a consequent PG1 pressure equal to PA1, without the valve 11 presence λ would remain steady during all the modulation range; the valve 11 intervenes to modify λ following the input formulated by 15 according to the flame ratio detected by 14A, modifying in PGF1 the pressure upstream injector 23 therefore the fuel gas flow rate and consequently λ in the mixture, between a fixed minimum and maximum deviation, a flame ratio increase causing a λ decrease and vice versa, in order to maintain said flame distance around a pre-fixed optimum value.

In the ignition phase the valve 11 is completely open to maintain a λ value lower for a certain time.

Figure 7:
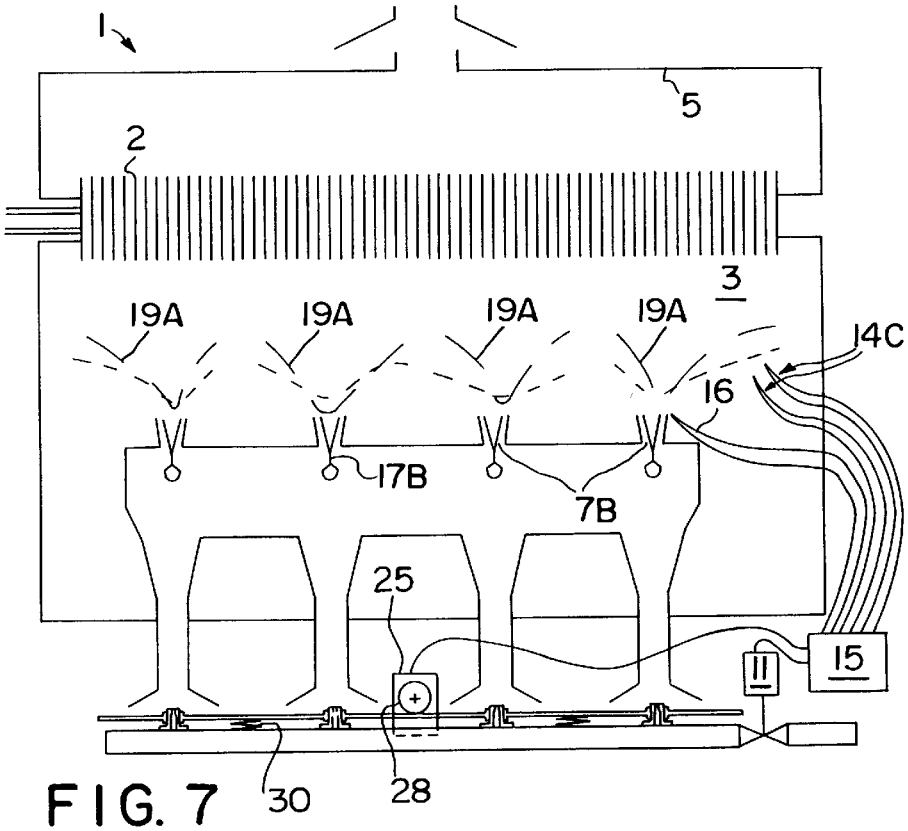
FIGS. 7–9 illustrate a combustion system with atmospheric burner partially premixed, natural draught, λ variation according to the flame ratio and variation of the outflow velocity according to the temperature of the flame opening.

FIG. 7 shows a natural draught combustion system which employs an atmospheric partially premixed burner 8A of the extractible type, lip shaped flame openings 7B (perpendicularly lengthened to the drawing) on burner head 6 and internal fluids dynamic obstacles with V shaped cross section, made from bimetallic sheets. Being the centre distance among exits 7B big, the flame, ignited by a device not seen, divides itself in long separate V shaped lamellar flames 19A (perpendicularly lengthened to the drawing). The process controller 15, upon signal of flame ratio from the temperature sensor 14C through step by step motor 25 varies the primary air flow as better described in FIG. 9.

Moreover a thermocouple 16 put on a flame opening lip 7B1 allows to maintain at the minimum the λ value in ignition until the lip temperature has not reached a value of let's say 150° C.

Figure 8:
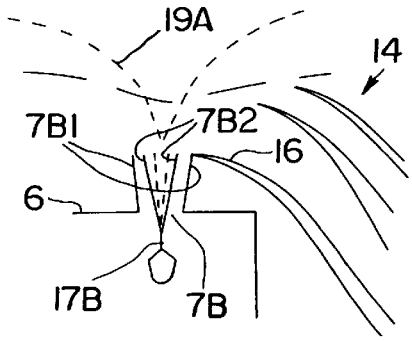

At the same time, as described in the enlarged section of a flame opening 7B of FIG. 8 the internal bimetallic sheet V shaped obstacle, according to the temperature reached changes the cross section of the opening 7B therefore changing the outflow velocity so to favour the stability. For higher temperatures (continuous line) smaller cross section, the contrary (dashed line) for lower temperatures.

Figure 9:
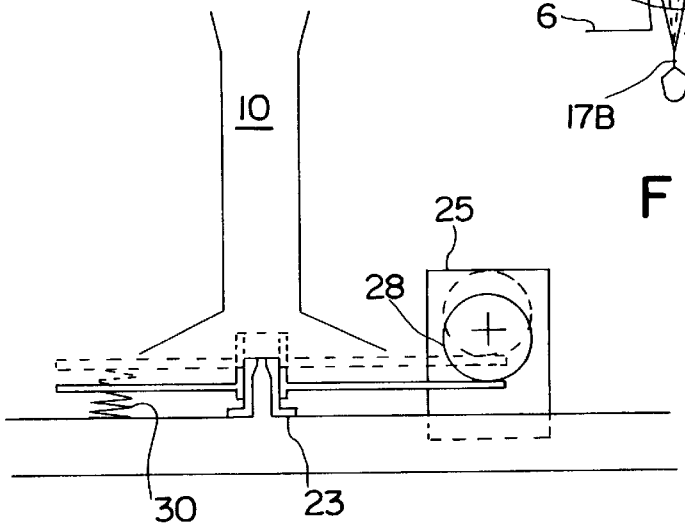

In FIG. 9 is shown how the rotation of the eccentric axis 28 varies the primary air flow to the Venturi through 9A moving the sleeve sliding on the gas injector 23 to maintain steady the flame position with the λ variation as often described. Two positions of the sleeve regulating λ in the mixture are displayed: continuous line for maximum λ, dashed line for minimum λ.

Figure 10:
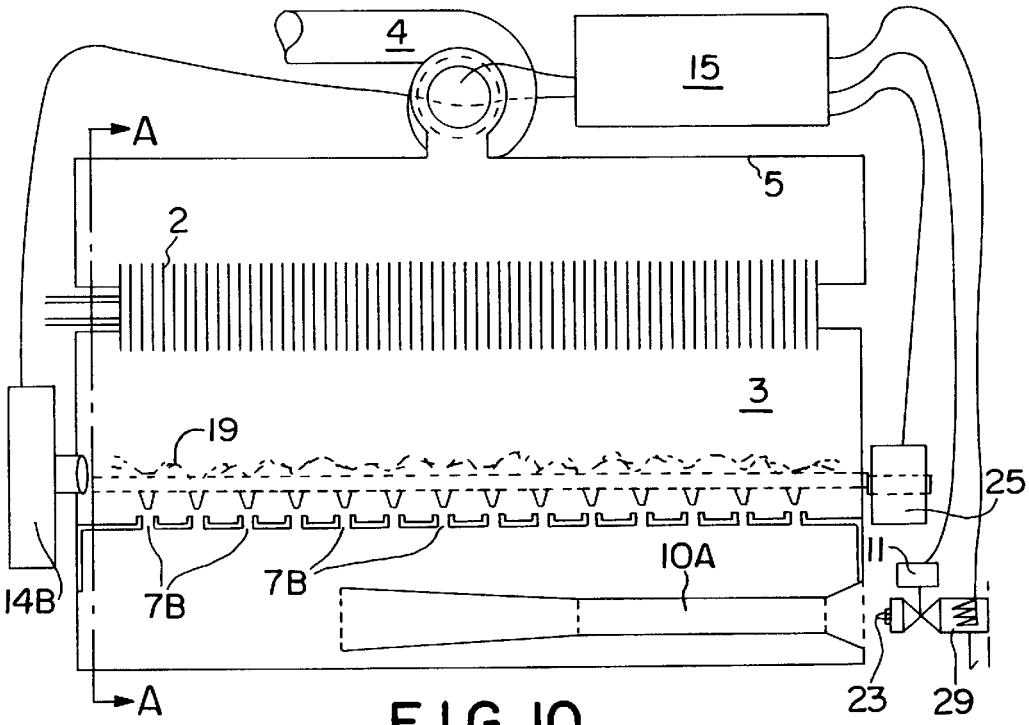
FIGS. 10–12 illustrate a combustion system with atmospheric burner, forced draught, λ variation according to the flame ratio and outflow velocity according to the fuel-gas flow rate, or vice versa.

In the combustion system of FIG. 10 the fan 4 is downstream the exchanger 2, the burner, with a Venturi tube 10A, is atmospheric totally premixed, (nevertheless passages for secondary air among the openings 7B can be provided). The flame openings 7B are lengthened, perpendicularly to the drawing surface, and made from lips obtained with the sheet of burner head 6. On the centre line axis of the flow from openings 7B, in combustion chamber 3, at a distance which can reach ten times the flame opening width are put V section fluids dynamics obstacles 12A with vertexes upstream which cause stagnation downstream having the dimension perpendicular to the axis of the same magnitude of the flame openings 7B width which, in this case, can be between 2 and 4 mm, while the lips height can vary from 10 to 20 mm; the obstacles have the same length of the flame openings perpendicularly to the drawing.

The flame 19, ignited by a device not seen, stays steadily anchored downstream the obstacles 12A becoming wave shaped carpet as the flame openings are close enough to each other. A variation of the heat request causes a change of the valve 11 opening, the fuel-gas flow rate is controlled by the warm wire sensor 29 which sends a signal to 15 to modify the eccentric axis 28 position driven by the step by step motor which moves the external obstacles 12A to modify the flame openings cross section 7B so as to maintain almost constant the velocity of the mixture outflow At the same time the fan 4 spin velocity is modified by the process controller 15 according to the signal of the flame ratio detected by the optical sensor 14B so that the λ variation in the mixture maintains the flame distance at the best position as already described.

Figure 11:
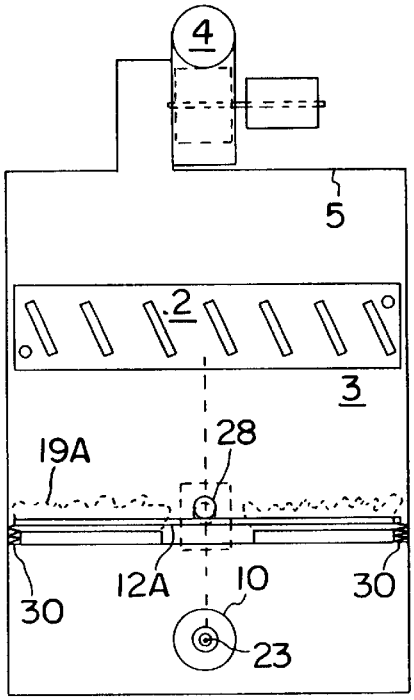
Figure 12:
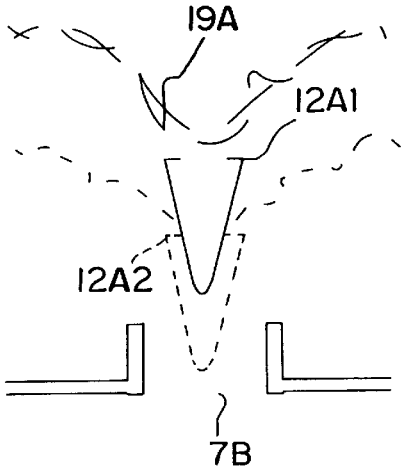

FIG. 11 is a view from A—A section of FIG. 10, the obstacles 12A balanced on the springs 30 pressed at the centre by the eccentric axis 28 which can move them, each other parallely in a vertical way to modify the cross section of the flame openings 7B of FIG. 10 as better seen in the section of FIG. 12 where these obstacles are in intermediate position (continuous line) and in reduced passage position (dashed line)

The same combustion system of FIG. 10, 11, if the case with unimportant changes, but using a different controll process with a different controller device can be regulated in this new way:

the signal of the fuel gas flow rate from the warm wire sensor 29 is worked out from the process controller to vary the value of λ according to the said flow rate by changing the fan spin velocity as well described previously.

the signal of flame ratio transmitted from the optical-sensor 14B is worked out from said controller to change the eccentric axis 28 position driven by the step by step motor 25 which moves the external obstacles 12A to vary the flame openings cross section 7B so as to modify the mixture outflow velocity to maintain the flame at the best position according to the flame ration variation law.

The movement of the external obstacles 12A is either upwards or downwards whether the flame ratio 19 rises or lowers itself, the movement can be gradual, or on-off, up to closing the flame openings according to the needs.

In FIG. 13 is shown a natural draft combustion system with partially premixed atmospheric burners of extractible type 8A; a spark ignition device 13 which at the start, ignite the mixture out flowing from flame opening of left burner to form a first V shaped lamellar flame 19A which cross-ignites the other burners 7B creating similar flames remaining separate. It is also shown, but more detailed in FIG. 14, how a temperature sensor 17A of the flame opening lips, which corresponds, in a reduced modulation range, to a flame distance sensor, can also be the actuator of the movement, capable of modifying the outflow cross section directly, as mobile part 7B2 of the flame opening which has fixed lips 7B1; in fact the two bimetallic sheets, which occupy longitudinally all the flame opening where they are mounted, are coupled together by longitudinal welding at the low edges so that, heating themselves the upper edges, symmetrically spread as regards to the central axis of the flame opening itself, as per dashed line in FIG. 14. These sheets at room temperature are pre-charged in order not to move away the upper edge until the temperature of same does not reach approx. 150° C.

In FIG. 15 is shown a forced draught combustion system with partially premixed atmospheric burner; and in more details in FIG. 16 is shown the temperature sensor 17B of the flame opening 7B, which is, in a limited range, equivalent to a sensor of the flame distance, is also actuator of the movement able to modify the outflow cross section directly, as mobile part 7B2 of the flame opening 7B, in this case is a sealed bulb seensor 17B, filled with a fluid, which expand at the temperature increase and shrinking at its decreasing, its upper lips 7B2 which are part of the flame opening 7B with fixed lips 7B1, makes outflow cross section of said openings directly change.

Figure 19:
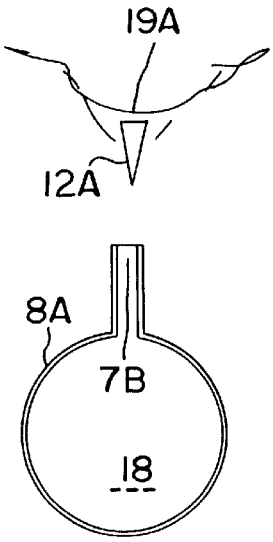
FIGS. 17–19 illustrate a burner of the extractible type with variation of the outflow cross section according to the temperature of the exit area of the flame openings using bimetallic strips
Figure 17:
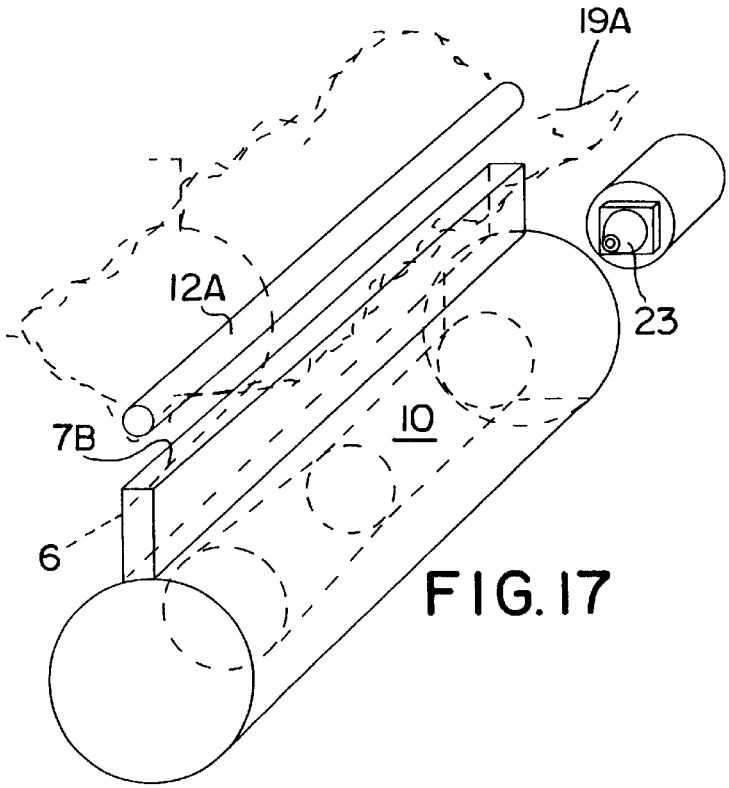
Figure 18:
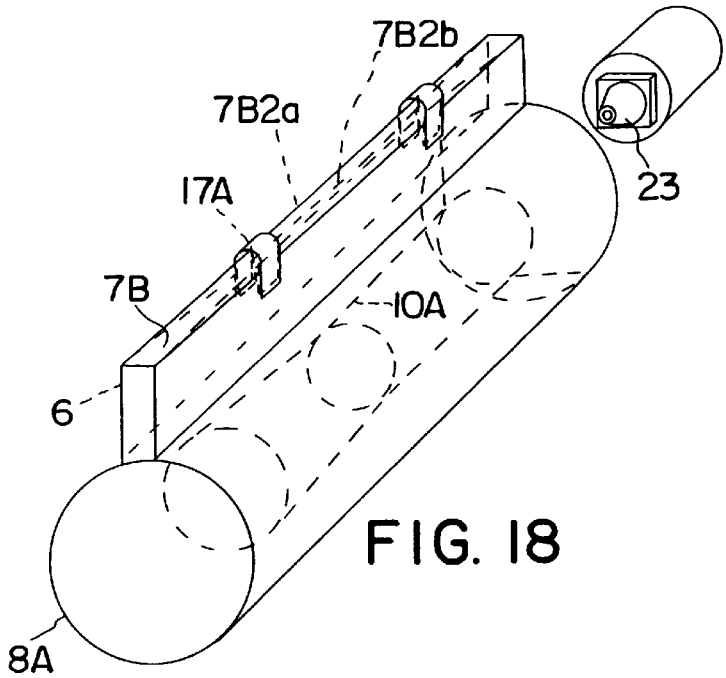

In fact the expansion or contraction of the fluid in the bulb can modify the transverse section of this to directly modify the outflow section. In FIG. 17 is shown a burner 8A with a sole flame 19A. In FIG. 18 the same burner is shown without the flame, the opening 7B having only two mobile lips 7B2, which define the outflow cross section of it, moved by the deformation (temperature function of the flame opening and therefore of the flame distance) of two bimetallic sensors-actuators 17A. The lips 7B2 position full line drawn and the dashed drawn one correspond to two different conditions of the flame opening temperature obviously higher the one corresponding to the dashed line. An external fluids dynamics V shaped obstacle positioned with the central axis on centerplane of the burner at a distance from the flame opening edges of 3 to 10 times the width of the flame opening with a cross dimension of the same magnitude of said width, anchors the large V shaped flame. FIG. 19 shows a cross section of a slightly different burner.

Figure 20:
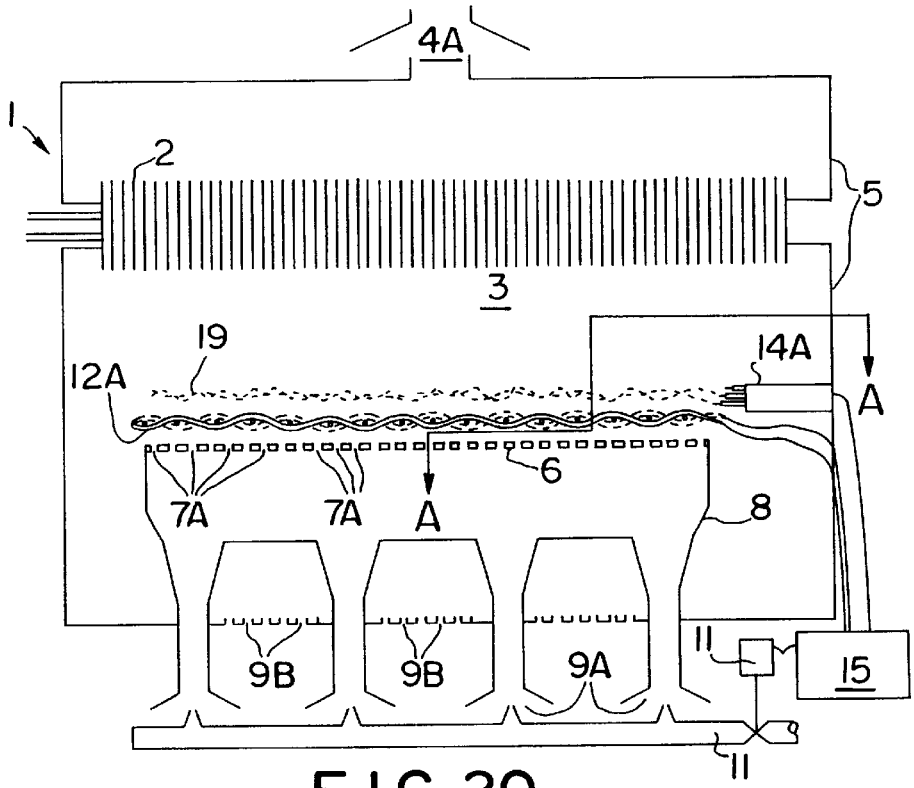
FIG. 20 illustrates a combustion system with variation of the mixture temperature according to the flame ratio; the mixture is heated by a wire heating element positioned in the combustion chamber, covering its plan with mesh.
Figure 21:
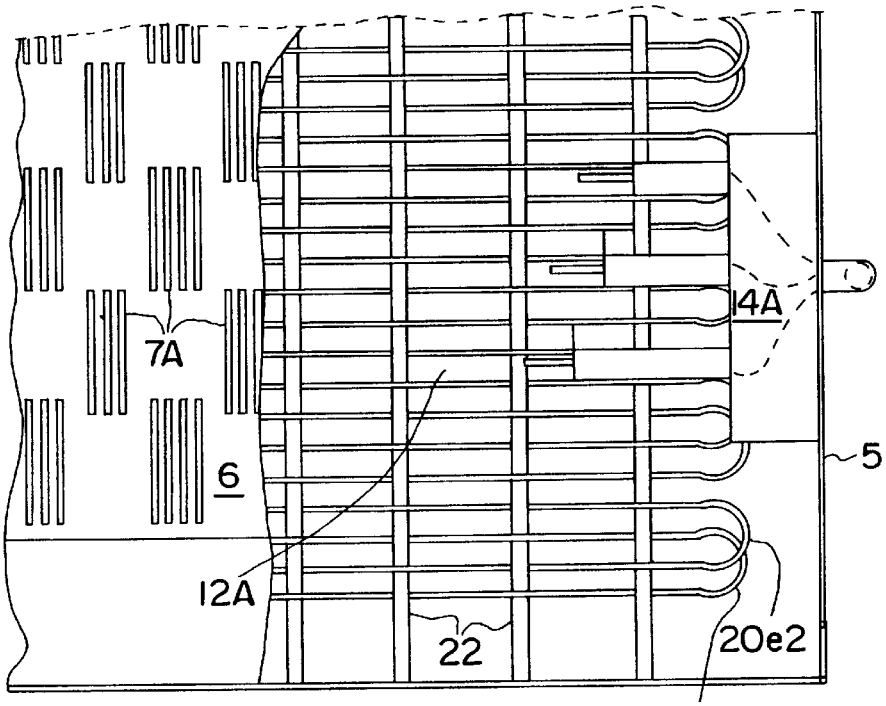
FIG. 21 shows an enlarged plan view of the burner head.
Figure 22:
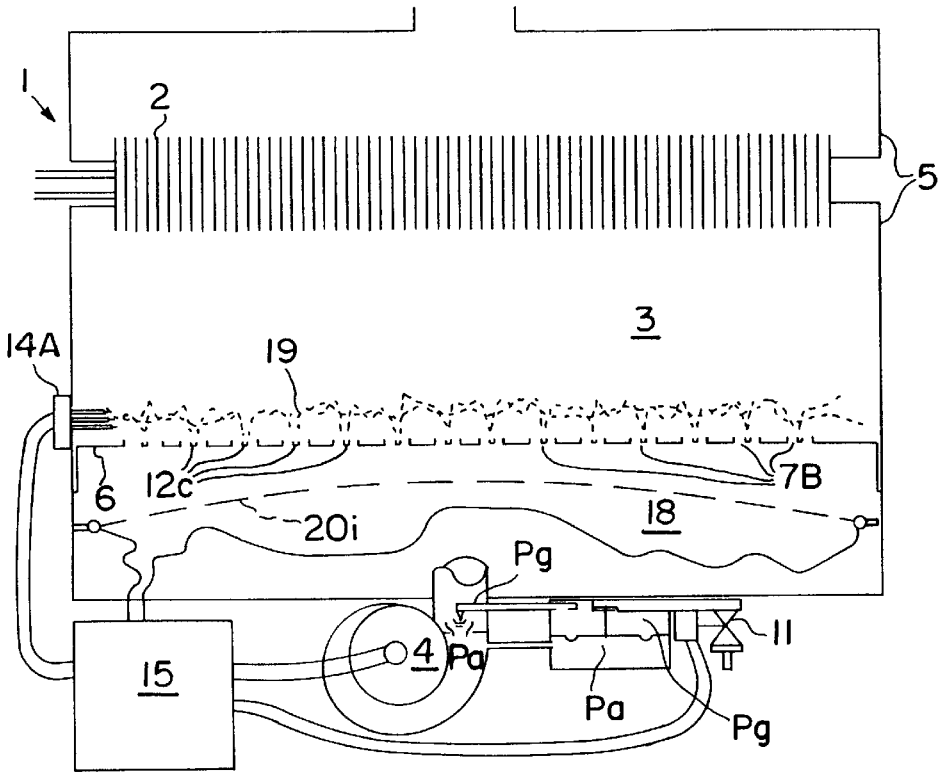
FIG. 22 illustrates shows a pressurised combustion system with variation of the mixture temperature according to the flame ratio and where λ is maintained steady at the changing of the instantaneous fuel-gas flow rate; the mixture is heated by a heating element inside the burner.

In FIG. 20 is shown a natural draught combustion system with atmospheric burner having a head 6 in perforated sheet metal the variation of the mixture temperature is realised according to the flame ratio, detected by a ionisation current sensor, able to detect the average value of the ionisation current, in three different positions using three electrodes on different levels and distance from the nearest flame opening, so that by any fuel gas flow rate, at least one electrode will detect the ionisation current upstream the flame front, a net made of parallel ceramic rods 22 in one direction and wires heating element perpendicularly, covering the combustion chamber plan said wires if under a predeterminated electrical tension are heated to a temperature around 1000° C.; therefore are capable of igniting the mixture. In case the wires are organised in more than one circuit, 20*e*1 and 20*e*2 acting also as part of the fluids dynamic obstacle, as shown in FIG. 21, after the ignition the variation of the mixture temperature, obtained upstream the flame front, can vary by steps; FIG. 21 shows an enlarged plan view of the burner head, slots parallel each other combined in groups of three and four, these said groups (the flame openings) are distributed in a check pattern to obtain a flying carpet shape lamellar flame 19 of FIG. 20. In FIG. 22 shows a pressurised combustion system I (the fan is upstream the combustion chamber 3), the heat request produces a variation of the fan 4 spin velocity, consequently a variation of the air pressure Pa=Pg means fuel gas low rate, mantaining λ constant at the changing of the instantaneous fuel-gas flow rate; the variation of the mixture temperature up stream the flame front 19 according to the flame ratio detected by the ionisation sensor 14A, which works as that of FIG. 20, worked out from the controller 15 changes the electric input to the heating element 20*i* which never reaches such temperatures to risk the ignition of the mixture inside the burner chamber 18; the wave carpet type flame pattern is obtained with a series of t-wings rows of slots forming openings 7B having obstacles 12C, the ignition device is not shown.

Figure 23:
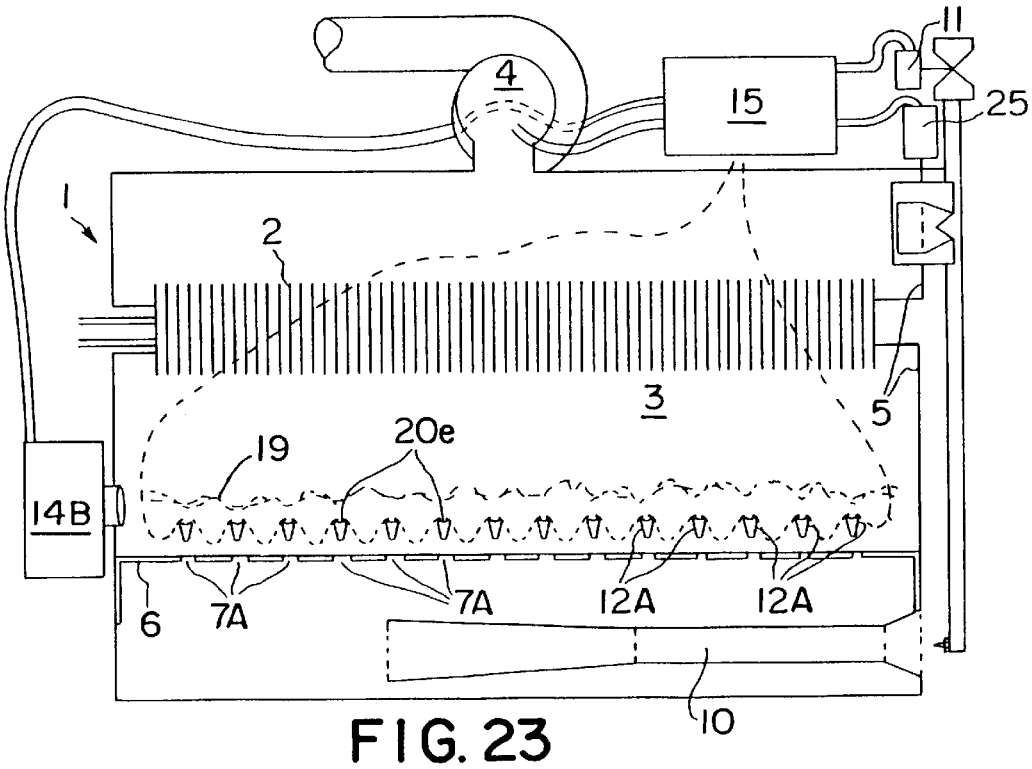
FIG. 23 shows a forced draught combustion system with variation of the mixture temperature and of λ according to the flame ratio, the mixture is heated by a heating element which acts also as fluids dynamics obstacle.
Figure 27:
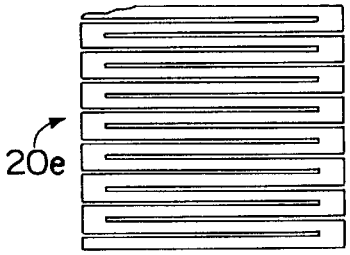
Figure 26:
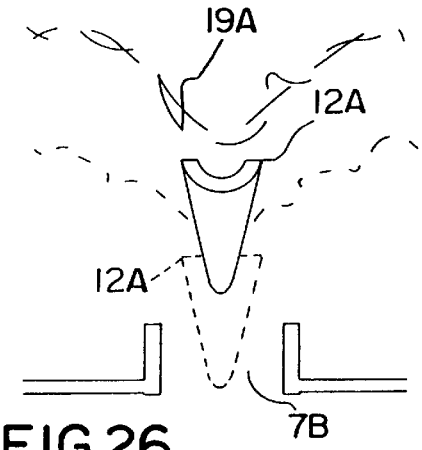

In FIG. 23 is shown a forced draught combustion system using an optical device to detect the flame ratio as to permit to the controller 15 the variation of the mixture temperature and of λ (as in FIG. 1,2,3) according to said flame ratio; the mixture is heated by a heating element 20*i* which acts also as fluids dynamics obstacle, V shaped, made of special steel sheet metal, punched as shown in FIG. 27, supported by a ceramic rod; the slots punched on the sheet metal head 6, organised in rows near each other, together with the V shaped obstacle produce carpet lamellar flame.

Figure 24:
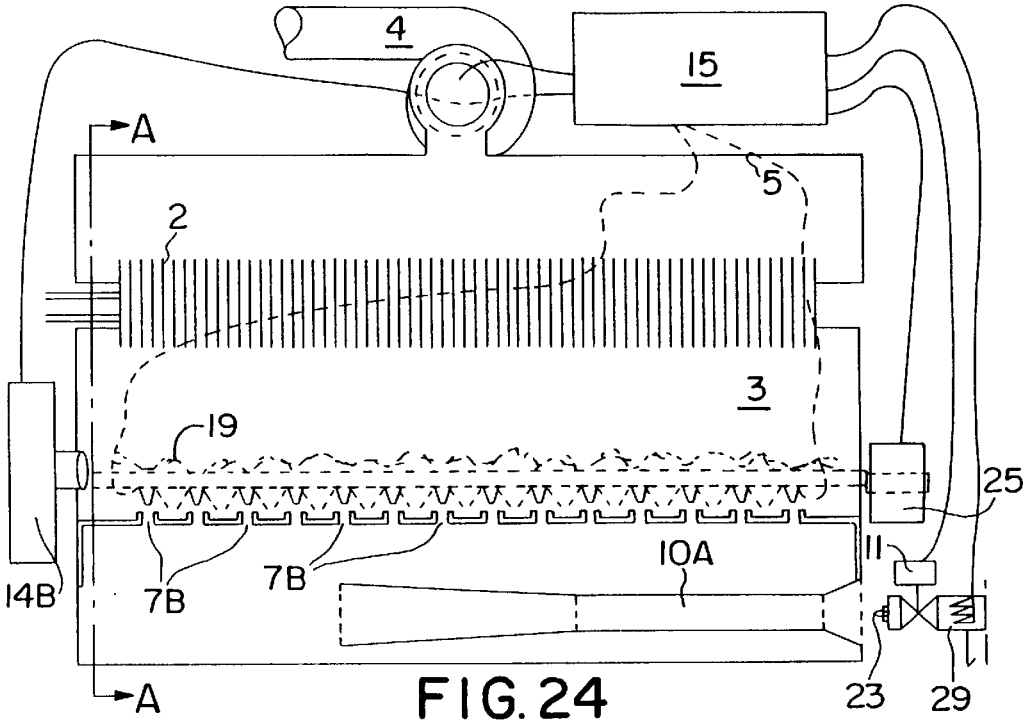
FIGS. 24–27 illustrate a forced draught combustion system with variation of the temperature and of the outflow velocity of the mixture according to the flame ratio, the mixture is heated by a heating element downstream the flame openings which also acts as fluids dynamics obstacle.
Figure 25:
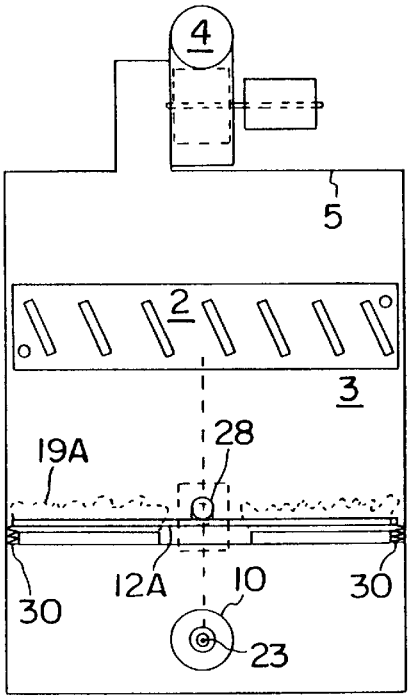

In FIG. 24 and 25 is shown a forced draught combustion system 1 with variation of the temperature and of the outflow velocity of the mixture according to the flame ratio; the mixture is heated by a heating element downstream the flame openings which also acts as fluids dynamics obstacle as in FIG. 23 moved up and down to vary the outflow velocity of the mixture as in FIG. 10, 11, 12 but using as control parameter the flame ratio as the temperature variation.

Although the foregoing invention has been described in some detail by way of illustration and example for purposes of clarity of understanding, it will be obvious to those skilled in the art that certain changes and modifications may be praticed without departing from the spirit and scope thereof as described in the specification and as defined in the appended claims.

What is claimed is:

1. A method for controlling a combustion system, comprising the steps of:

providing a combustion chamber, a fan connected to the combustion chamber and having a spin velocity, a burner adjacent the combustion chamber, one or more flame openings defined by the burner, each flame opening having a cross section, an obstacle associated with each of the one or more flame openings, each obstacle being within the combustion chamber, a mixture having a mixture temperature discharged at a discharge velocity from the one or more flame openings and a flame along the burner substantially detached from the one or more flame openings;

sensing a position of the flame;

generating a flame position signal based on the sensed position;

controlling a characteristic variable quantity of the mixture based on the flame position signal;

wherein the characteristic variable quantity is selected from the group consisting of (i) a premixture rate value of the mixture, (ii) the discharge velocity, and (iii) the mixture temperature upstream of the flame;

controlling a Premixture rate value of the mixture and the discharge velocity by varying the cross section of at least one of the flame openings and the spin velocity of the fan; and maintaining the flame around a prefixed optimum position.

2. The method of claim 1, wherein:

the flame is lamellar.

3. The method of claim 1, further comprising the step of:

sensing the mixture temperature upstream of the flame.

4. The method of claim 1, further comprising the step of:

sensing an ionization current upstream of the flame.

5. The method of claim 1, further comprising the step of:

detecting a position of a source of emissions generated inside the flame.

6. The method of claim 1, further comprising the steps of:

modifying the discharge velocity based on the sensed position, and modifying the mixture temperature upstream of the flame based on the discharge velocity.

7. The method of claim 1, further comprising the step of:

controlling the mixture temperature upstream of the flame and a premixture rate value of the mixture based on the sensed position.

8. The method of claim 1, further comprising the step of:

controlling the mixture temperature upstream of the flame and the discharge velocity based on the sensed position.

9. The method of claim 1, further comprising the step of:

controlling the temperature of the mixture upstream of the flame and the discharge velocity by modifying the cross section of the one or more flame openings.

10. The method of claim 1, further comprising the step of:

comparing the sensed position to the prefixed optimum position to determine a flame ratio.

11. The method of claim 10, further comprising the step of:

controlling the characteristic variable quantity of the mixture based on the flame ratio.

12. The method of claim 10, further comprising the step of:

varying a premixture rate value of the mixture between a minimum value and a maximum value based on the flame ratio.

13. The method of claim 10, further comprising the step of:

modifying the discharge velocity by varying the cross section of at least one of the flame openings between a minimum section and a maximum section.

14. The method of claim 10, further comprising the step of:

varying the mixture temperature upstream of the flame between a minimum value and a maximum value.

15. A combustion system, comprising:

a combustion chamber, a fan connected to the combustion chamber and having a spin velocity, a burner adjacent the combustion chamber, one or more flame openings defined by the burner, each flame opening having a cross section, an obstacle associated with each of the one or more flame openings, each obstacle being within the combustion chamber, a mixture of fuel gas and air having a mixture temperature discharged at a discharge velocity from the one or more flame openings, a flame along the burner substantially detached from the one or more openings, a flame position sensor sensing a position of the flame and generating a flame position signal based on the sensed position of the flame, and a control processor maintaining the flame around a prefixed optimum position by controlling a characteristic variable quantity of the mixture based on the flame position signal, the characteristic variable quantity being selected from the group consisting of a premixture rate value of the mixture, the discharge velocity, and the mixture temperature upstream of the flame;

wherein the discharge velocity is modified by varying the cross section of at least one of the flame openings and the spin velocity of the fan.

16. The system of claim 15, wherein:

the flame position sensor includes a temperature sensor upstream of the flame.

17. The system of claim 15, wherein:

the flame position sensor includes an ionization current sensor.

18. The system of claim 15, wherein:

the flame position sensor includes an optical sensor.

19. The system of claim 15, wherein:

the control processor compares the sensed position to the prefixed optimum position to determine a flame ratio.

20. The system of claim 19, wherein:

the premixture rate value is varied between a prefixed minimum and maximum value according to the flame ratio.

21. The system of claim 19, wherein:

the mixture temperature is varied upstream of the flame between a prefixed minimum and maximum value according to the flame ratio.

22. The system of claim 15, further comprising:

a heating element positioned upstream of the flame varying the mixture temperature.

23. The system of claim 15, wherein:

the obstacles are movable with respect to the one or more flame openings to open and close the one or more flame openings.

24. The system of claim 15, wherein:

the cross section of at least one of the flame openings is modifiable.

25. The system of claim 24, wherein:

the at least one flame opening includes a mobile part that is gradually and continually movable.

26. The system of claim 24, wherein:

the flame position sensor senses the temperature of the at least one flame opening and modifies the cross section of the at least one flame opening.

27. The system of claim 15, further comprising:

a temperature sensor associated with each of the one or more flame openings.

* * * * *